US010811747B2

(12) United States Patent
Oppenlaender et al.

(10) Patent No.: US 10,811,747 B2
(45) Date of Patent: Oct. 20, 2020

(54) PHASE-CONTROLLED ANTENNA ARRAY

(71) Applicant: Lisa Draexlmaier GmbH, Vilsbiburg (DE)

(72) Inventors: Joerg Oppenlaender, Kirchentellinsfurt (DE); Alexander Moessinger, Tuebingen (DE)

(73) Assignee: LISA DRAEXLMAIER GMBH, Vilsbiburg (DE)

( * ) Notice: Subject to any disclaimer, the term of this patent is extended or adjusted under 35 U.S.C. 154(b) by 69 days.

(21) Appl. No.: 16/316,002

(22) PCT Filed: Jun. 27, 2017

(86) PCT No.: PCT/EP2017/065887
§ 371 (c)(1),
(2) Date: Jan. 7, 2019

(87) PCT Pub. No.: WO2018/007210
PCT Pub. Date: Jan. 11, 2018

(65) Prior Publication Data

US 2019/0157730 A1 May 23, 2019

(30) Foreign Application Priority Data

Jul. 8, 2016 (DE) ..... 10 2016 112 581

(51) Int. Cl.
*H01P 1/18* (2006.01)
*H01Q 15/24* (2006.01)
(Continued)

(52) U.S. Cl.
CPC ..... *H01P 1/182* (2013.01); *H01Q 3/32* (2013.01); *H01Q 3/34* (2013.01);
(Continued)

(58) Field of Classification Search
CPC .. H01P 1/182; H01P 1/18; H01Q 3/34; H01Q 3/36; H01Q 15/24; H01Q 15/242;
(Continued)

(56) References Cited

U.S. PATENT DOCUMENTS 2,716,221 A 8/1955 Allen
6,822,615 B2 11/2004 Quan et al.
(Continued)

FOREIGN PATENT DOCUMENTS

CN 103107386 A 5/2013
DE 3741501 C1 2/1989
(Continued)

OTHER PUBLICATIONS

International Search Report for corresponding International Application No. PCT/EP2017/065887 dated Sep. 9, 2017 (22 pages).
(Continued)

*Primary Examiner* — John Bedtelyon
(74) *Attorney, Agent, or Firm* — Jacob Eisenberg

(57) ABSTRACT

A phase-controlled antenna array comprises at least four phase-controlled elements which are connected via a feed network. Each antenna element comprises a waveguide emitter with a signal output coupling or input coupling and a phase actuator which is rotatably attached in the waveguide emitter and contains a mounting and two polarizers, wherein each of the two polarizers can convert a circularly polarized signal into a linearly polarized signal. The antenna elements additionally comprise a connection element and a drive unit which is attached to a support and which is connected to the phase actuator via the connection element such that the drive unit can rotate the phrase actuator about an axis of the waveguide emitter. The antenna array additionally comprises a computing unit which is connected to the drive unit(s) of the phase-controlled antenna elements
(Continued)

via control lines and which adjusts the rotation of each phase actuator.

13 Claims, 11 Drawing Sheets

(51) Int. Cl.

| | |
|---|---|
| ***H01Q 13/02*** | (2006.01) |
| ***H01Q 3/32*** | (2006.01) |
| ***H01Q 3/34*** | (2006.01) |
| ***H01Q 21/06*** | (2006.01) |
| ***H01Q 21/00*** | (2006.01) |

(52) U.S. Cl.
CPC ..... *H01Q 13/0241* (2013.01); *H01Q 15/244* (2013.01); *H01Q 21/0018* (2013.01); *H01Q 21/0037* (2013.01); *H01Q 21/064* (2013.01)

(58) Field of Classification Search
CPC ..... H01Q 15/244; H01Q 15/246; H01Q 21/0018; H01Q 21/0025; H01Q 21/0037; H01Q 21/00
See application file for complete search history.

(56) References Cited

U.S. PATENT DOCUMENTS

| | | | | |
|---|---|---|---|---|
| 9,257,734 | B2 * | 2/2016 | Hoover | H01P 1/182 |
| 2010/0109960 | A1 | 5/2010 | Guler et al. | |

FOREIGN PATENT DOCUMENTS

| | | | |
|---|---|---|---|
| DE | 102007003388 | A1 | 8/2007 |
| DE | 20101014916 | A1 | 10/2012 |
| EP | 2955788 | A1 | 12/2015 |
| JP | 55-102901 | | 8/1980 |
| WO | WO 02/084797 | A1 | 10/2002 |

OTHER PUBLICATIONS

Office Action of corresponding German Patent Application No. 10 2016 112 581.4 dated Mar. 6, 2017 (8 pages).

* cited by examiner

PHASE-CONTROLLED ANTENNA ARRAY

CROSS REFERENCE TO RELATED APPLICATIONS

This application is a national phase application of International Application No. PCT/EP2017/065887, filed Jun. 27, 2017, and claims the priority of German Application No. 10 2016 112 581.4, filed Jul. 8, 2016, the content of both of which is incorporated herein by reference.

FIELD

The present disclosure relates to a phase-controlled antenna array, in particular for the GHz frequency range and for use on mobile carriers, such as motor vehicles, aircraft, or ships.

BACKGROUND

In mobile applications, a phase control system (such as a phase steering mechanism) of an antenna array has the function of always optimally aligning the primary beam of the antenna array with a target during the spatial motion of a mobile carrier. In many cases, a permanent radio relay link with the target antenna must be reliably maintained, even if the carrier is moving fast.

With the aid of the phase control system, however, even with a stationary or mobile antenna array, a moving target can be followed, as is the case for instance in radar applications.

It is known that with the aid of variable, controllable phase actuators ("phase shifters"), the antenna diagram of stationary antenna arrays can be spatially varied, and thus the primary beam can be pivoted in various directions.

The phase actuators vary the relative phase position of the signals that are received or sent by various individual members of the antenna arrays. If the relative phase position of the signals of the individual antennas is adjusted accordingly with the aid of the phase actuators, then the primary beam ("main beam") of the antenna orientation diagram of the antenna array points in the desired direction.

The currently known phase actuators are mostly constructed of nonlinear solid bodies ("solid state phase shifters"), mostly ferrites, microswitches (MEMS technology, binary switches), or liquid crystals. All of these technologies, however, have the disadvantage that on the one hand they often lead to considerable signal loss, since some of the high-frequency power is dissipated in the phase actuators. Particularly in applications in the GHz range, the antenna efficiency of the antenna arrays drops sharply as a result.

This presents a considerable problem, particularly for antenna arrays which are intended for use in mobile carriers, since in these applications on account of the limited space available, antennas with the highest possible efficiency are needed. The antennas must be as small and lightweight as possible, which cannot be achieved with the known phase controllers.

Conventional phase actuators must furthermore always be accommodated in the feed networks of the antenna arrays, which typically makes such antenna arrays very heavy or makes their thickness very great.

In contrast to this, particularly for applications on fast-moving carriers, such as aircraft and trains, small and lightweight antenna systems with a low profile are wanted.

Furthermore, phase-controlled antenna arrays in which conventional phase actuators are used are very expensive. Particularly for civilian applications above 10 GHz, this prevents their use.

A further problem is the demands made for accurate control of the antenna diagram of the antenna arrays. If the antenna arrays are used in radio link applications with satellites, then stringent demands are made in terms of the regulatory conformity of the antenna diagram. For every primary beam direction, the diagram in the sending mode must be faithful to the regulatory mask. This can be ensured reliably only by providing that every time, both the amplitude and the phase of each individual antenna element of the antenna array are known.

None of the currently known technologies for phase actuators, however, allows reliable instantaneous, that is, immediate determination, without making further calculation available, of the phase position of the signal downstream of the phase actuator. To do so would require the ability to determine the status of the phase actuator reliably at all times. However, that is not practically possible with either solid-state or MEMS nor liquid crystal phase actuators.

From DE 37 41 501 C1, a feed system for an antenna is known that can transmit different polarized waves. The feed system uses a fixed 90° phase shifter and a movable 180° phase shifter, so that the phase position of the two waves to one another is adjustable. From U.S. Pat. No. 6,822,615 B2, an antenna field with phase shifters between a first and a second part of the antenna field is known. Finally, DE 10 2010 014 916 B4 shows an antenna array with a feed network that forms coherent groups of individual emitters.

SUMMARY

In view of the above limitations of the related art, an object of certain embodiments of the present disclosure may therefore be to make a phase-controlled antenna array, in particular in the GHz frequency range and particularly for use in mobile carriers, available which 1. allows the exact alignment and control of the primary beam of the antenna array;
2. enables the exact control and monitoring of the relative phase position of the signals of the various antenna elements of the antenna array;
3. at every time allows the instantaneous determination of the phase position and the relative amplitude of the signal applied to an antenna element of the antenna array and in every state of the antenna array allows the determination of its antenna diagram;
4. has no or only very slight losses;
5. has a low profile and low weight; and
6. is economical to achieve.

In some embodiments of the disclosure, the above object may be attained by a phase-controlled antenna array according to a first aspect. Advantageous refinements of embodiments of the disclosure can be learned from this and other aspects as discussed in the specification, and the drawings. Objects and advantages of the disclosed embodiments may be realized and attained by the elements and combinations set forth in the claims. However, embodiments of the present disclosure are not necessarily required to achieve such exemplary objects and advantages, and some embodiments may not achieve any of the stated objects and advantages.

The phase-controlled antenna array of the first aspect may include at least four phase-controlled antenna elements connected via at least one feed network. The antenna elements each include one waveguide emitter with a signal output or input coupling, one phase actuator, which is mounted rotatably in the waveguide emitter, one mounting, and at least two polarizers; each of the at least two polarizers can convert a circularly polarized signals into a linearly polarized signal. Furthermore, the antenna elements includes a connection element and a drive unit, which is mounted on a carrier and is connected via the connection element to the phase actuator in such a way that the drive unit can rotate the phase actuator about an axis of the waveguide emitter. The antenna array further includes a computing unit, which via control lines is connected to the drive unit or units of the phase-controlled antenna elements and adjusts the rotation of the various phase actuators.

Further advantages and features of the present disclosure will become clear from the following description of exemplary embodiments. The features described therein and above can be implemented on their own or in combination, provided the features do not contradict one another. It is to be understood that both the foregoing general description and the following detailed description are exemplary and explanatory only and are not restrictive of the subject matter as claimed.

BRIEF DESCRIPTION OF THE DRAWINGS

The above and other aspects of the present disclosure will become more apparent by describing exemplary embodiments in detail below with reference to the accompanying drawings, in which.

DETAILED DESCRIPTION

As used throughout the present disclosure, unless specifically stated otherwise, the term "or" encompasses all possible combinations, except where infeasible. For example, the expression "A or B" shall mean A alone, B alone, or A and B together. If it is stated that a component includes "A, B, or C," then, unless specifically stated otherwise or infeasible, the component may include A, or B, or C, or A and B, or A and C, or B and C, or A and B and C. Expressions such as "at least one of" do not necessarily modify an entirety of a following list and do not necessarily modify each member of the list, such that "at least one of A, B, and C" should be understood as including only one of A, only one of B, only one of C, or any combination of A, B, and C.

Figure 1:
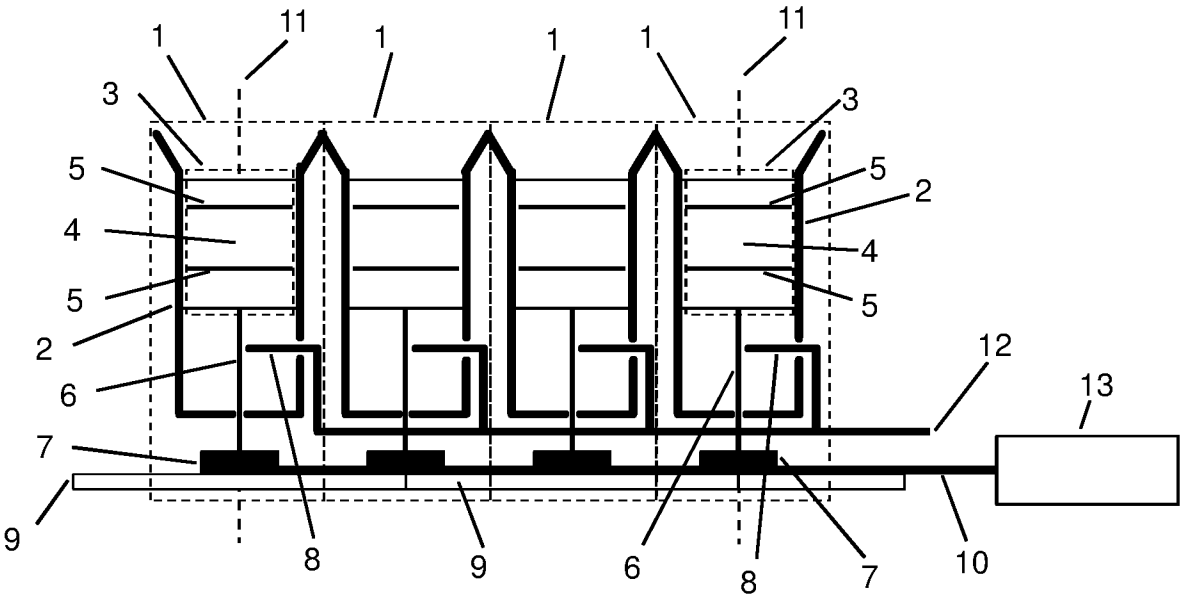
FIG. 1 shows an exemplary three-dimensional arrangement of elements of an antenna array, consistent with embodiments of the present disclosure.

One exemplary three-dimensional arrangement of the elements of an antenna array is shown in FIG. 1. Here, as examples, four antenna elements 1 are arranged in a row. However, an arrangement of the antenna elements 1 with a greater number or in a plurality of rows, in other words two-dimensionally, can also be done. A computing unit 13 controls the entire antenna array. Each of the antenna elements 1 has its own drive unit 7. That unit can, as will later be shown, also be further simplified in that common drive units 7 are used for a plurality of antenna elements 1.

Figure 2:
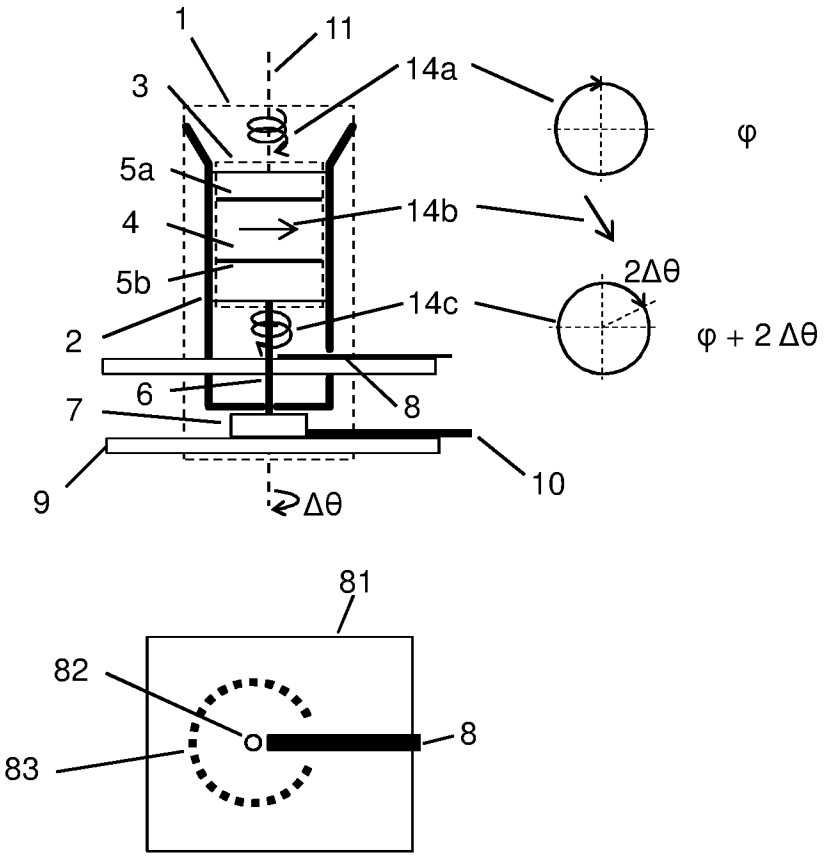
FIG. 2 shows a basic mode of operation of a phase-controlled antenna element, consistent with embodiments of the present disclosure.

The basic mode of operation of a phase-controlled antenna element is shown in FIG. 2. Polarizers may be configured to convert between linearly polarized and circularly polarized signals. A wave 14*a* with circular polarization and a phase position $\phi$ entering the waveguide emitter 2 of the antenna element 1 is transformed by the first polarizer 5*a* of the phase actuator 3 into a wave with linear polarization 14*b*. This wave with linear polarization is reconverted by the second polarizer 5*b* of the phase actuator 3 into a wave with circular polarization 14*c*.

If the phase actuator 3, with the aid of the drive unit 7 and the connection element 6 (which may include a shaft), is now rotated about an angle $\Delta\theta$, then the polarization vector of the linear wave 14*b* also rotates between the two polarizers 5*a* and 5*b* in a plane perpendicular to the direction of propagation. Since the polarizer 5*a* rotates along with them, the circular wave 14*c*, which is generated by the second polarizer 5*b*, now has a phase position of $\phi+2\ \Delta\theta$. The circular wave 14*c* with the phase position $\phi+2\ \Delta\theta$ can thereupon, with the aid of the signal output or input coupling 8, be uncoupled from the waveguide emitter 2 of the antenna element 1, or coupled into the waveguide emitter 2. The signal output or input coupling 8 may be configured to input- or output-couple two orthogonal modes.

The drive unit 7 is mounted on a carrier 9 (which may include a support) and is supplied via supply lines with the requisite energy and via control lines 10, with the aid of the computing unit 13, with the information necessary for the rotation about the angle $\Delta\theta$.

Because of construction requirements in the phase control system of the antenna element 1, the dependency of the phase angle difference between the outgoing 14*c* and incoming 14*a* circular wave on the rotation of the phase actuator 3 is strictly linear and constant and is strictly $2\pi$ periodic. Furthermore, each arbitrary phase rotation or phase shift can be adjusted continuously by the drive unit 7.

Since the phase actuator 3, considered electrodynamically, may be a purely passive component that contains no nonlinear component parts whatsoever, its function is fully reciprocal. In other words, a wave which runs from bottom to top through the phase actuator 3 is rotated in its phase in the same way as a wave which runs from top to bottom through the phase actuator 3.

The phase position of a signal sent or received by the waveguide emitter 2 of the antenna element 1 can thus be adjusted at will. The simultaneous sending and receiving mode is also possible.

The signal output or input coupling 8 is embodied, as shown in FIG. 2, as a microstrip line on a substrate 81. The waveguide emitter 2 of the antenna element 1 is provided for this purpose with a recess at the location of the input coupling or output coupling, which recess enables introducing the microstrip line together with the substrate into the waveguide emitter 2. So that the high-frequency currents flowing at the inner walls of the waveguide emitter 2 are not impeded, electrically conductive throughplugs ("vias") 83 are provided, which establish an electrical contact between the upper and lower sides of the waveguide emitter 2. A recess 82 in the substrate 81 is furthermore provided, by means of which the connection element 6 that connects the drive unit 7 to the phase actuator 3 can be guided.

If a plurality of phase-controlled antenna elements 1 are now interconnected, the result is a phase-controlled antenna array according to an embodiment of the disclosure. This is schematically shown in FIG. 3*a* and FIG. 3*b*.

Figure 3A:
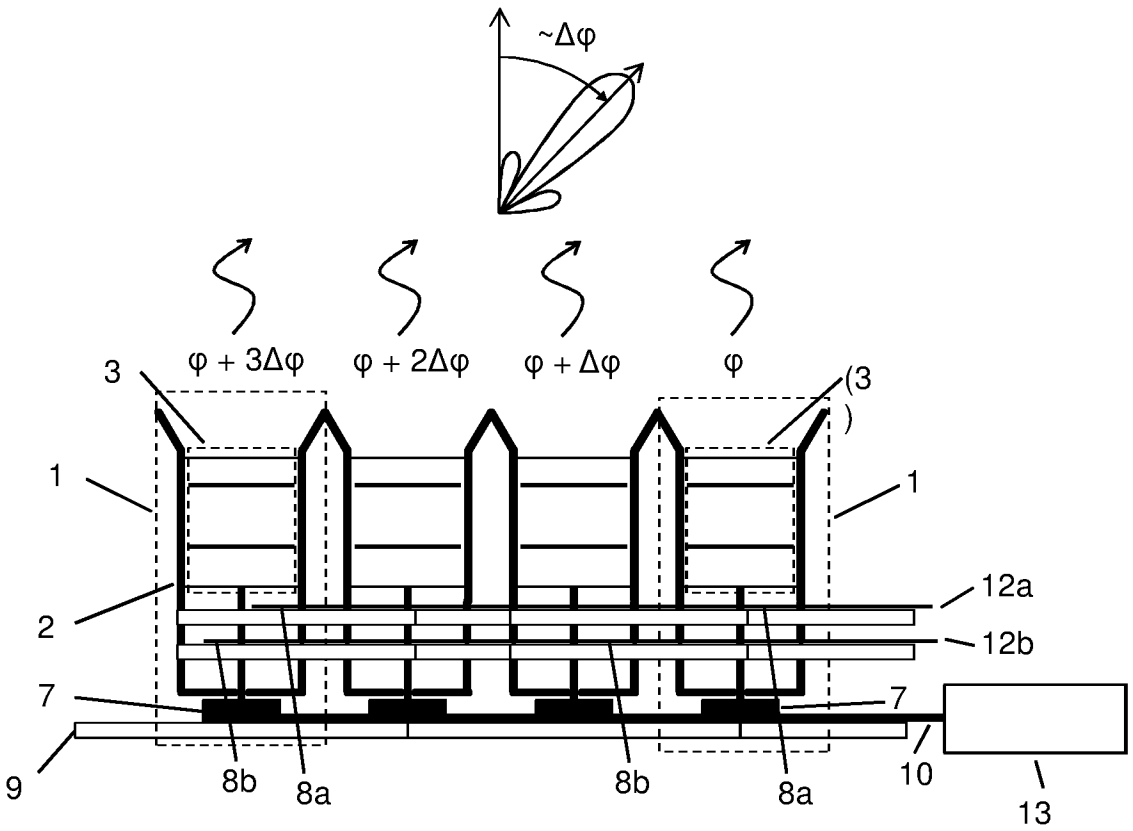
FIG. 3*a* schematically shows an antenna array and FIG. 3*b* shows an associated feed network, consistent with embodiments of the present disclosure.
Figure 3B:
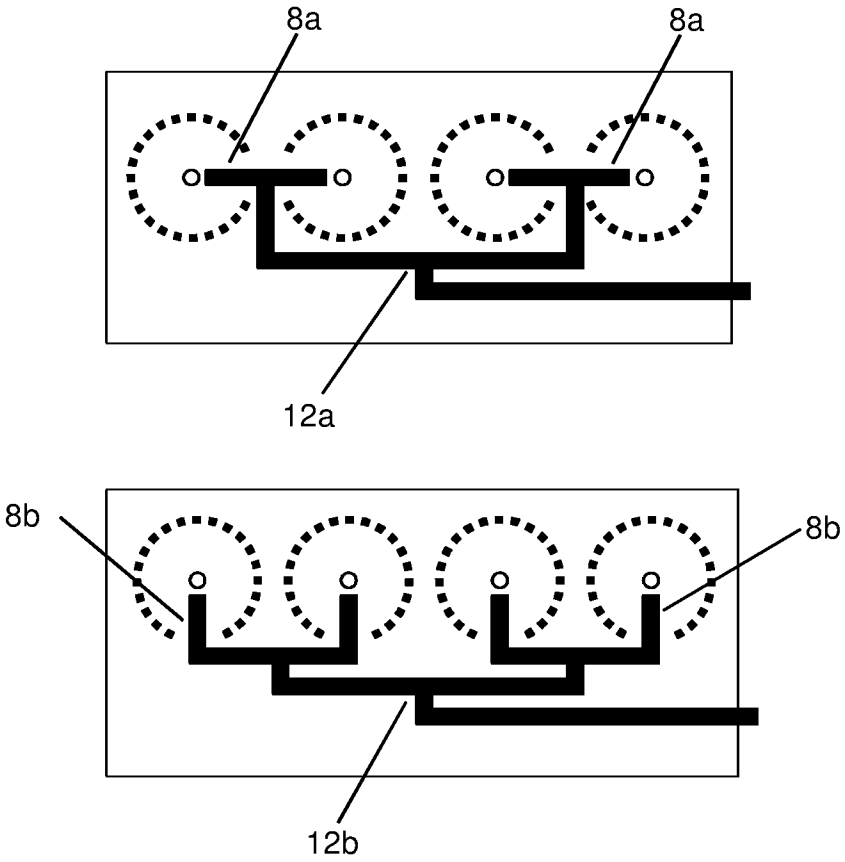

FIG. 3*a* schematically shows the antenna array; FIG. 3*b* shows the associated feed network 12. It consists of two networks (12*a*) and (12*b*), which each process orthogonal polarization.

The signals of all four antenna elements 1 are joined together, or in ascending mode distributed, via the feed networks 12*a* and 12*b*, which contain the input and output couplings 8*a* and 8*b*, respectively. In some embodiments, arrangement of input and output couplings may be reversed.

A phase controller may include a phase actuator, connection element and drive unit. Controlling the drive unit 7 of the individual phase controllers is done by a computing unit 13, which can for instance be an electronic control unit such as a microprocessor that is connected to the signal lines 10 which connect all the drive units to the computing unit. An electronic control unit may be programmed to implement various processing for carrying out functions and methods consistent with the disclosure, for example.

The input and output couplings 8*a* and 8*b*, and the feed networks 12*a* and 12*b* are embodied as microstrip lines on a substrate, analogously to what is shown in FIG. 2.

The signal output or input coupling 8 may furthermore be embodied as split in two as pin- or stylus-like, orthogonal microstrip lines 8*a* and 8*b* on separate substrates.

Such embodiments can be advantageous, if two signals of orthogonal polarization are to be received or sent simultaneously by the antenna array. Phase imbalances can also be compensated for, when the signals are processed in an orthogonal system.

If the phase actuator 3 is now adjusted with the aid of the computing unit 13 such that between the signals of the individual elements, there is a constant, relative phase difference $\Delta\phi$, then the primary beam of the antenna array points in a defined direction, which is dependent on the phase difference $\Delta\phi$.

Since via the feed network 12 the amplitude relations of the sent and received signals of the individual antenna elements 1 are precisely known and additionally, via the phase actuators 3, the phase position of each of these signals can be determined precisely, the antenna diagram of the antenna array is determined entirely deterministically in every state of the antenna array (in other words, also at any arbitrary time).

If the requisite computation power in a microprocessor or some other point in the antenna system is available, it is therefore possible to calculate the entire antenna diagram analytically with very high precision at any time. Especially with a view to the regulatory conformity of the antenna diagram typically required in civilian applications, this represents a substantial advantage of arrangements according to embodiments of the disclosure.

Even if the antenna arrays contain several thousand individual elements, as is typically the case for instance in the frequency range above 10 GHz, it is possible with the aid of a Fast Fourier Transform (FFT) for the corresponding antenna diagram to be calculated very precisely with relatively little computation power. Correspondingly fast FFT algorithms are well known.

The weight of the phase controller (phase actuator 3, connection element 6, and drive unit 7) of the individual antenna elements 1 is typically very low. If the polarizers 5 are made by thin-film technology on thin RF substrates, and if the holder 4 is made from closed-cell foam, then the weight of the phase controller amounts typically amounts to only a few grams. Therefore, even for the drive unit, only very small, lightweight actuators, such as microelectromotors, are necessary. The weight of such microelectromotors is likewise in the gram range.

The weight of an individual phase controller, in particular in the frequency range above 10 GHz, then amounts to only a few grams, which even in antenna arrays with a thousand individual emitters results in a total weight for the entire phase control system of the antenna array of only a few kilograms. This is advantageous in particular in applications on aircraft, where the weight should be as low as possible.

There may also be very slight dissipation in the phase control system according to some embodiments of the disclosure. The heat input of the phase actuators may be negligible, because there may be only very slight ohmic losses. If electromotors are used as drive units, their efficiency is typically >95%, so that even the drive units create practically no heat input. Furthermore, the power consumption, for instance of micromotors, is only in the mW range, so that the power requirement of the phase controllers, even in antenna arrays with a thousand individual emitters, is only a few watts.

This is a further advantage of the phase control system of embodiments of the disclosure. Even in antenna arrays with many thousand individual emitters, active cooling is not necessary, neither in the sending mode nor in the receiving mode. In contrast to this, in antenna arrays which use conventional semiconductor phase shifters or MEMS phase shifters, complicated and expensive active cooling is indispensable, at least in the sending mode, on account of the high losses.

The feed networks 12 may comprise suspended strip lines, which may include suspended microstrip lines. For example, the feed networks 12 of the phase-controlled antenna array can, as schematically shown in FIG. 3*b*, consist of microstrip lines on a suitable RF substrate. To minimize losses, these microstrip lines can also be embodied as suspended microstrip lines, that is, in a coaxial construction mode. Also, parts of the feed networks 12 can comprise waveguides, which can still further reduce the losses.

Hence it is advantageous for instance to connect groups of phase-controlled antenna elements within the antenna arrays via microstrip lines and then further to connect these groups via waveguides. Such hybrid feed networks then allow a high antenna element density. If the long distances, for instance in large antenna arrays, are embodied in waveguide technology, then the losses still remain limited.

Because of its construction, the wave impedance of the antenna element 1 is entirely independent of the relative phase position of an incoming and an outgoing wave. That is typically not the case in antenna elements which are controlled in their phase position with the aid of nonlinear phase shifters, such as semiconductor phase shifters or liquid crystal phase shifters. There, the wave impedance is dependent on the relative phase position, which makes those components hard to control.

The waveguide emitter 2 is preferably designed such that it contains at least one cylindrical waveguide piece. This definitely ensures that in its interior, a cylindrically symmetrical electromagnetic oscillation mode (mode) having circular polarization can develop, which can be transformed by the polarizers 5 into a mode of linear polarization.

Both the waveguide closure of the waveguide emitter and its opening (aperture), conversely, need not necessarily have a circular cross section. Depending on the type of output or input coupling, the waveguide closure can for instance be embodied conically or as stepped on one side. The aperture of the waveguide emitter can, for instance in use in two-dimensional antenna fields, also be designed conically (horn emitter), quadratically, or rectangularly.

However, since cylindrically symmetrical modes can also develop in waveguides with noncircular cross sections, such as elliptical or polygonal cross sections, still other structural forms of the waveguide emitter are possible.

For applications above 10 GHz, for densely packed antenna arrays, it can be advantageous to embody the waveguide emitter as a round waveguide, since such waveguides permit the greatest packing density and furthermore support cylindrically symmetrical hollow-body modes.

To improve the antenna gain of the phase-controlled antenna element, it can furthermore be advantageous to design the waveguide emitter as a horn emitter.

Furthermore, in terms of dimensions, the design of the waveguide emitter 2 for a particular operating frequency band may be done by known methods of antenna technology.

The pivot axis 11 of the phase actuators 3 is preferably located in the axis of symmetry of the respective cylindrical waveguide piece, which preferably contains every waveguide emitter 2.

The polarizers 5*a* and 5*b* are preferably mounted perpendicular to the axis of rotation 11 and parallel to one another in the holder 4 (which may include a mounting).

For the rotation of the phase actuator 3, a rotation about a quarter-circle (−45° to) +45°) typically suffices, in the case of an antenna array, to achieve a pivot range of −90° to +90° and thus to cover the entire hemisphere above the antenna.

The phase controller then operates practically without loss, since given a corresponding design, the losses induced by the polarizers 5*a* and 5*b* and the dielectric holder 4 are very slight. At frequencies of 20 GHz, for example, the entire losses amount to less than 0.2 dB, which is equivalent to an efficiency of more than 95%. Conventional phase shifters, conversely, typically already have losses of several dB at those frequencies.

In terms of its high-frequency properties, a phase-controlled antenna array of some embodiments of the disclosure is therefore hardly distinguishable from a comparable antenna field without phase control.

For instance, it is known that dielectrically filled horn emitters, for instance, particularly at frequencies over 20 GHz, are used on account of their high antenna efficiency in antenna fields. If such antenna fields are realized as phase-controlled antenna arrays in accordance with some embodiments of the disclosure, then the RF properties, in particular antenna gain and antenna efficiency, of the antenna fields advantageously do not change, despite the additional phase control.

If the drive unit 7 is equipped with an angular position transmitter, or if it is itself already an angular position transmitter (such as some piezoelectromotors, for instance), then the phase position of the wave 14*a* emitted by the waveguide emitter can be determined instantaneously exactly at any time.

On account of the simple construction of the phase actuator 3 and because of the fact that only very simply constructed drives 7 may be required for the quarter-circle rotation, the phase control can be achieved very economically. Even large phase-controlled antenna arrays with many thousand antenna elements are readily possible.

As drive units 7, there may be provided electromotors, which may include microelectromotors or piezoelectromotors. In some embodiments, economical electromotors or microelectromotors, as well as piezoelectromotors, or simple actuators, which are constructed from electroactive materials, can for example be taken into consideration.

Advantageously, the drive units may include SMD (surface mount device) components, which can be soldered directly onto a suitable circuit board serving as a carrier 9. The supply and control lines 10 can then be embodied as microstrip lines, which permits a high integration density.

The connection element 6 is preferably embodied as a shaft and advantageously consists of a nonmetallic, dielectric plastic material, such as plastic. This has the advantage that cylindrical hollow-body modes are unimpeded, or only very slightly impeded, if the shaft is mounted symmetrically in the waveguide emitter 2.

If coaxial modes are used to operate the waveguide emitter (2), however, then metal shafts can be employed as well.

However, in some embodiments, the drive unit may be mounted for instance next to the waveguide emitter 2 and the connection element 6 for instance may consist of a belt, which is passed through small lateral openings in the waveguide emitter, and thus drives the phase actuator.

Furthermore, in some embodiments, the drive unit 7 may rotate the phase actuator 3 in contactless fashion, for instance via a rotating magnetic field. To that end, for instance via the terminus of the waveguide emitter, a magnetic rotator can be mounted, which then acts together with the rotating magnetic field as a connection element 6, for instance if parts of the polarizer consist of magnetic material.

The polarizers 5*a* and 5*b* can for instance consist of simple, planar meander polarizers, which are mounted onto a conventional carrier. These polarizers can be produced by known etching processes or by additive methods (e.g., "circuit printing").

Figure 4:
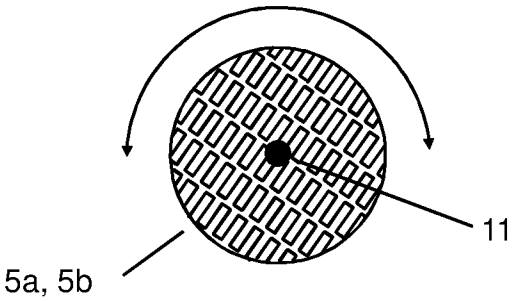
FIG. 4 shows a polarizer, consistent with embodiments of the present disclosure.

As shown in FIG. 4, the polarizers 5*a* and 5*b* preferably have a shape that is symmetrical to the axis 11, so that they can easily be accommodated in the cylindrically symmetrical waveguide piece of the waveguide emitter. For example, the carrier material of polarizers 5*a* and 5*b* may include a substrate that is rotationally symmetric about axis 11. The substrate may be circular.

The polarizer 5*a* and 5*b* shown in FIG. 4 is embodied as a meander polarizer. Multi-layer meander polarizers are advantageous, since they can have large frequency bandwidths and thus make broadband operation possible.

As is familiar to one skilled in the art, however, there are also many other possible embodiments of polarizers for electromagnetic waves, which can transform a wave of circular polarization into a wave of linear polarization.

For instance, in some embodiments, the conversion of the signal polarization may be effected not by means of planar polarizers but instead structures distributed in three dimensions in the mounting (such as septum polarizers). For the function of some embodiments of the present disclosure, the only criterion may be that these structures transform a wave of circular polarization entering the waveguide emitter 2 first into a wave of linear polarization and then can re-transform it back into a wave with circular polarization.

For the holder 4, closed-cell foams of low density, which are known to have very low RF losses, but also plastic materials, such as polytetrafluoroethylene (Teflon) or polyimides, can be used. Because particularly at frequencies above 10 GHz, the size of the phase actuator is slight in the range of one wavelength, the RF losses here as well remain very low given equivalent impedance adaptation to the equivalent electromagnetic mode in the waveguide emitter 2.

Since viewed electrodynamically the dimensional design of the phase actuator 3 at a specific operating frequency is effected in a similar way to the dimensional design of the waveguide emitter 2 at a specific operating frequency, the phase actuator 3 can typically be readily mounted in the interior of the waveguide emitter 2.

In each case, even if the dimension of the waveguide emitter 2 is chosen to be very small, it is possible by suitable selection of the dielectric constant for the material of the holder 4 to make the phase actuator 3 so small that there is space for it in the waveguide emitter 3.

Thus according to the known design specifications for a waveguide emitter, its minimal diameter is typically in the range of one wavelength at the operating frequency. The extending length of the waveguide emitter in the direction of the incident waves is typically a few wavelengths at the operating frequency.

Since the polarizers 5*a* and 5*b* and their spacing (for instance half a wavelength) from one another are likewise designed according to the wavelength of the operating frequency by the known method of impedance adaptation, the phase actuator may be configured so that its dimensions are always within the range of the dimension of the waveguide emitter.

At a frequency of 20 GHz, for example, the dimensions of the phase actuator 3 are typically in the range smaller than one wavelength, that is, about 1 cm×1 cm. If the holder 4 is designed as a dielectric packing material and the dielectric constant is selected as correspondingly large, then very many shape factors can also be achieved. The ohmic losses may rise slightly, but are still only in the range of a few percent.

Figure 5:
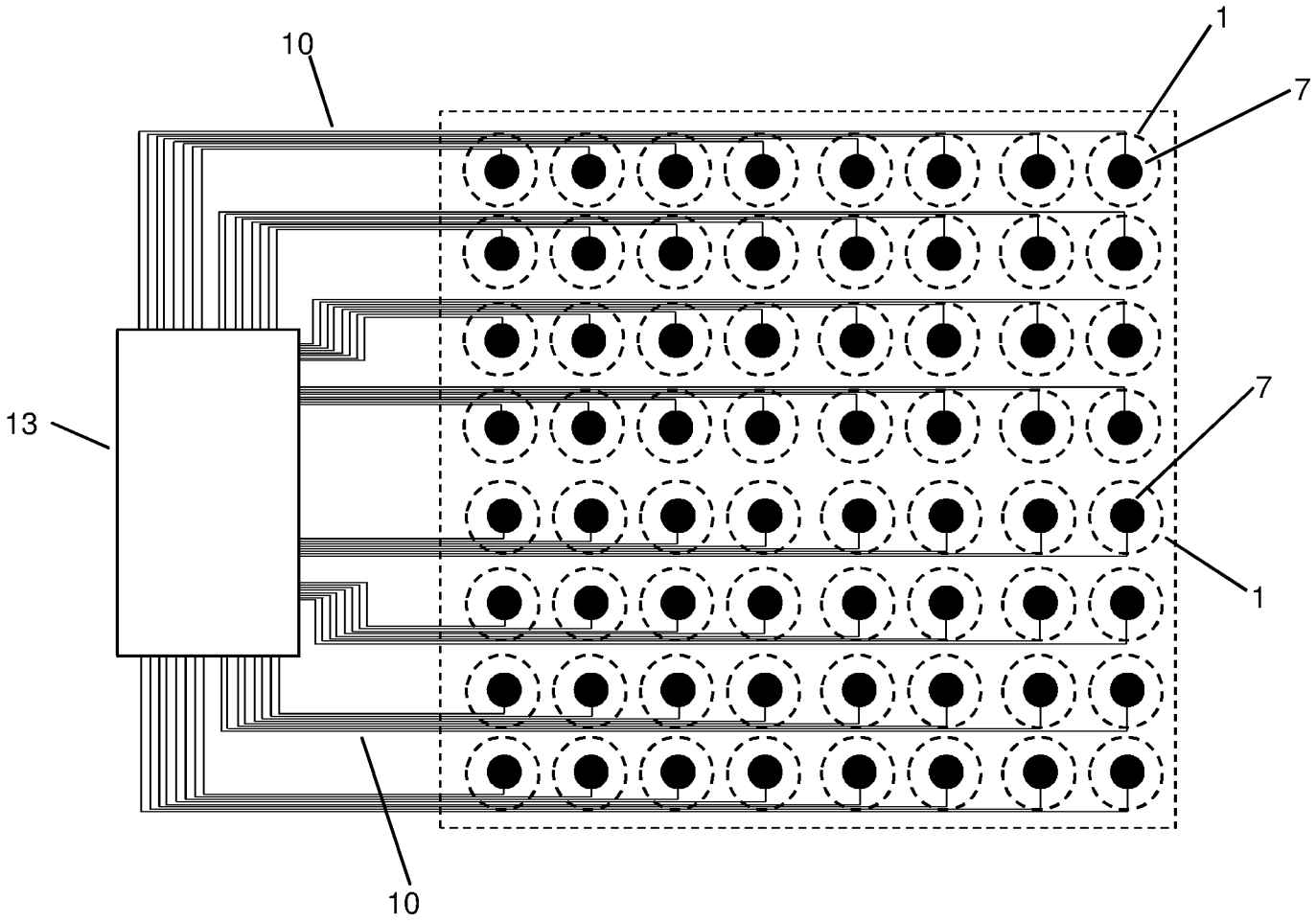
FIG. 5 shows a square antenna array, consistent with embodiments of the present disclosure.

In FIG. 5, one exemplary embodiment of a square antenna array with 8×8=64 phase-controlled antenna elements 1 is schematically shown.

The antenna elements 1 are located in a two-dimensional field, and the control lines 10 of the drive units 7 of the individual phase-controlled antenna elements 1 are connected to a computing unit 13 (which may be a microprocessor unit).

With the aid of such two-dimensional arrangements of phase-controlled antenna elements 1, the primary coil of the antenna diagram of the antenna field, which forms a two-dimensional antenna array, can be pivoted in any arbitrary direction in the hemisphere above the field.

The orientation of the antenna beam may be effected in a way analogous to what is shown in FIG. 3*a*, in that by means of the computing unit 13, the drive units 7 of the individual antenna elements are controlled in such a way that the phase actuators of the individual antenna elements 1 are rotated such that a defined relative phase relationship prevails between the antenna elements 1 of the antenna array.

The precision of the orientation of the primary beam is very high, because the phase position of the signals emitted or received by the individual antenna elements 1 can be arbitrarily adjusted with the aid of the phase controller and in principle even with arbitrary precision.

This represents a further considerable advantage of such antenna arrays, for instance in comparison to phase-controlled antenna arrays which use binary phase shifters. This is because with binary phase shifters, in principle the phase position of the individual signals can be adjusted only granularly in defined steps. High-precision orientation of the antenna diagram is thus in principle not possible.

The direct receiving or sending of signals with linear polarization by the phase-controlled antenna array may become possible as a result of the use of phase-controlled antenna elements in accordance with some aspects of the disclosure.

Figure 6:
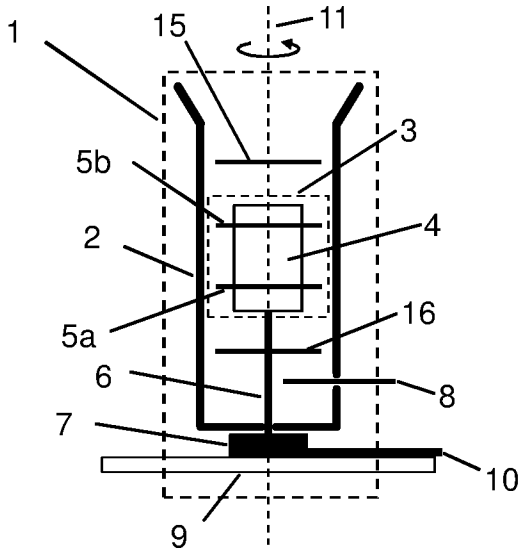
FIG. 6 shows an antenna element with an additional polarizer, consistent with embodiments of the present disclosure.

One such antenna element is shown schematically in FIG. 6 and is characterized in that in the waveguide emitter 2 of the phase-controlled antenna element 1 upstream of the phase actuator 3, at least one further polarizer 15 is mounted, which may be configured to transform signals with linear polarization into signals with circular polarization, and downstream of the phase actuator 3 and upstream of the output or input coupling 8, at least one further polarizer 16 is mounted, which may be configured to transform signals of circular polarization into signals of linear polarization.

The phase actuator 3 may furthermore include the holder 4 and the polarizers 5*a* and 5*b* and has a drive unit 7 that is connected via the connection element 6 to the phase actuator 3 or the holder 4 in such a way that the phase actuator 3 can be rotated in the waveguide emitter 2.

Because the first additional polarizer 15 converts an incoming signal of linear polarization into a signal of circular polarization, the phase actuator 3 can perform its function without further ado.

The polarizer 16, which is mounted downstream of the phase actuator 3 and upstream of the output or input coupling 8, transforms the signal of circular polarization generated by the phase actuator 3 back again into a signal of linear polarization, which can be directly output-coupled by an output or input coupling 8 designed to suit linear modes.

The function of the arrangement is again entirely reciprocal. In the case of sending, a linear mode in the waveguide emitter 2 is induced by the output or input coupling 8 and is transformed by the second polarizer 16 into a circular mode. A phase position dependent on the angle of rotation of the phase actuator 3 about the axis 11 is imposed on this circular mode by the phase actuator 3. The circularly polarized signal with the adjusted phase position, which the phase actuator 3 makes possible, is transformed by the first additional polarizer 15 into a signal with linear polarization and with the imposed phase position and is emitted by waveguide emitter 2 of the antenna element 1.

The arrangement shown in FIG. 6 furthermore functions for two simultaneously occurring orthogonal linear polarizations, when the signal output or input coupling 8 is designed accordingly for two orthogonal linear modes, for instance as shown in FIG. 3*a* and FIG. 3*b*.

It is likewise possible to send and receive signals of the same or different polarization simultaneously.

Figure 7:
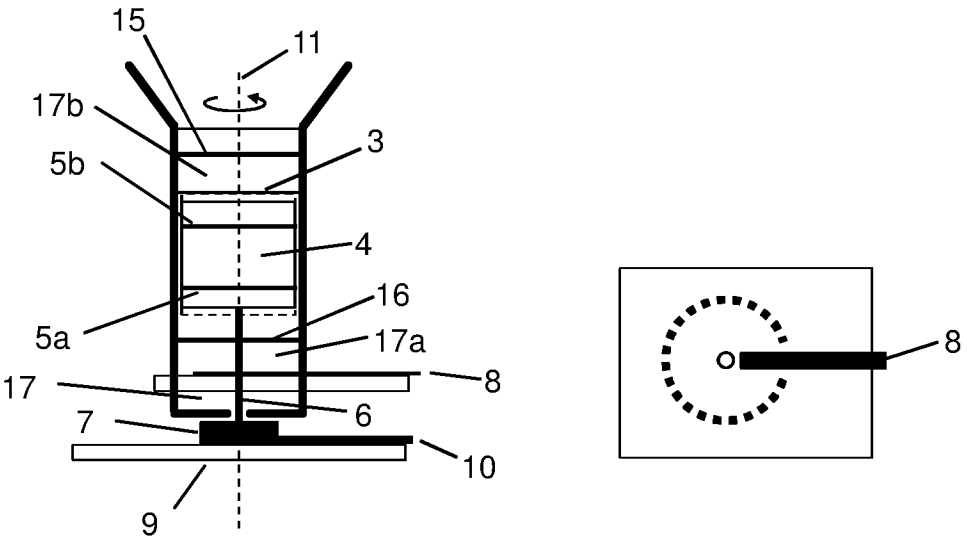
FIG. 7 shows an antenna element with a packing material, consistent with embodiments of the present disclosure.

One embodiment of the antenna element shown in FIG. 6 is shown schematically in FIG. 7.

The signal output and or input coupling 8 is embodied in one piece analogously to what is shown in FIG. 2, as a microstrip line on a substrate.

The additional polarizers 15 and 16 are embedded in a respective dielectric packing material 17*a* and 17*b* and are typically fixedly mounted in the waveguide emitter 2. The waveguide closure below the output and input coupling 8 is likewise filled with a dielectric packing material 17.

This construction has the advantage that the entire interior of the waveguide emitter 2 is filled with a typically identical dielectric and thus mode discontinuities cannot occur.

The polarizer 16 and its dielectric packing material 17*a*, like the dielectric packing material 17, have a recess for the connection element 6 analogous to the substrate (see FIG. 2, substrate 81), so that the connection element 6 can be freely rotated.

Analogously to the two-part coupling 8*a* and 8*b* shown in FIG. 3*a* and FIG. 3*b*, in some embodiments, such as the exemplary embodiment of FIG. 7, the output or input coupling 8 may be configured in two parts for two orthogonal linear modes.

Furthermore, in some embodiments, the first additional polarizer 15 may be configured to be rotatable and may be equipped with its own drive, so that this polarizer 15 can be rotated about the axis 11 independently of the phase actuator 3 in the waveguide emitter 2. This may useful to compensate for a polarization rotation of an incident wave.

Such an arrangement is particularly advantageous whenever in mobile applications, because of the motion of the carrier, a rotation of the polarization vector of the incident wave relative to the antenna array mounted fixedly on the carrier occurs.

Since such a polarization rotation is generally independent of the phase rotation that serves the purpose of the three-dimensional orientation of the antenna beam, there may be a configuration where the rotation of the polarizer is possible independent of the rotation of the phase actuator 3.

Figure 8:
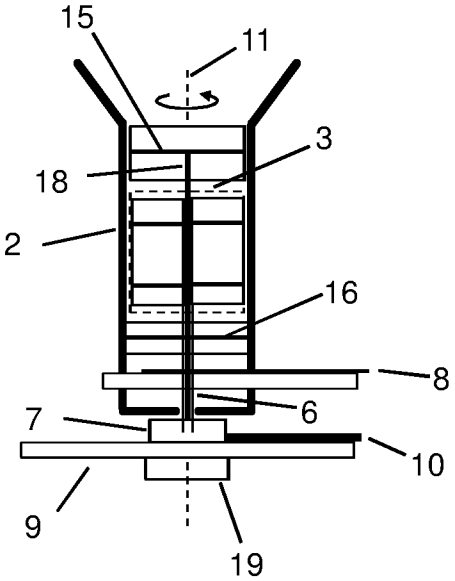
FIG. 8 shows an antenna element with a rotatable additional polarizer, consistent with embodiments of the present disclosure.

An exemplary embodiment of this kind is shown schematically in FIG. 8.

The first additional polarizer 15 is mounted rotatably in the waveguide emitter 2 and is connected with the aid of a shaft 18 to its own drive 19, so that the drive 19 can rotate the polarizer 15 about axis 11.

The rotation of the polarizer 15 independently from the rotation of the phase actuator 3 is achieved in the exemplary embodiment of FIG. 8 such that the shaft 6, which connects the phase actuator 3 to its drive 7, is embodied as a hollow shaft. Inside this hollow shaft is the shaft 18 that connects the polarizer 15 to its drive 19.

Since the polarization plane of a wave with linear polarization is defined only in an angle range of 180°, for the rotation of the polarizer 15 an angle range of −90° to +90°, or in other words a semicircular rotation, may suffice.

The second additional polarizer 16 is fixedly mounted in the waveguide emitter 2, since its orientation determines the orientation of the linear mode that is output or input by the output or input coupling 8. The fixed orientation of the polarizer 16 therefore orients itself according to the position of the output or input coupling 8.

If the output or input coupling 8 is embodied in two parts, for instance as in the exemplary embodiment of FIGS. 3*a* and 3*b*, then the polarizer 16 can also be omitted, since the circularly polarized signal generated by the phase actuator in principle contains all the information of the incident wave. For recombination of the original signal, a 90° hybrid coupler can then be used for instance, into which the signal split into the parts of the coupling 8*a* and 8*b* is fed.

For the phase-controlled antenna array, because of the construction of the phase control according to an embodiment of the disclosure, only a single 90° hybrid coupler may be required, which can be integrated into the feed network 12, for instance at the bottom point of the feed network 12 of the antenna array.

Since polarization rotations of an incident wave of linear polarization may affect all of the antenna elements of a phase-controlled antenna array in the same way, there may be an embodiment in which a rotatable polarizer is mounted above the antenna array.

Figure 9:
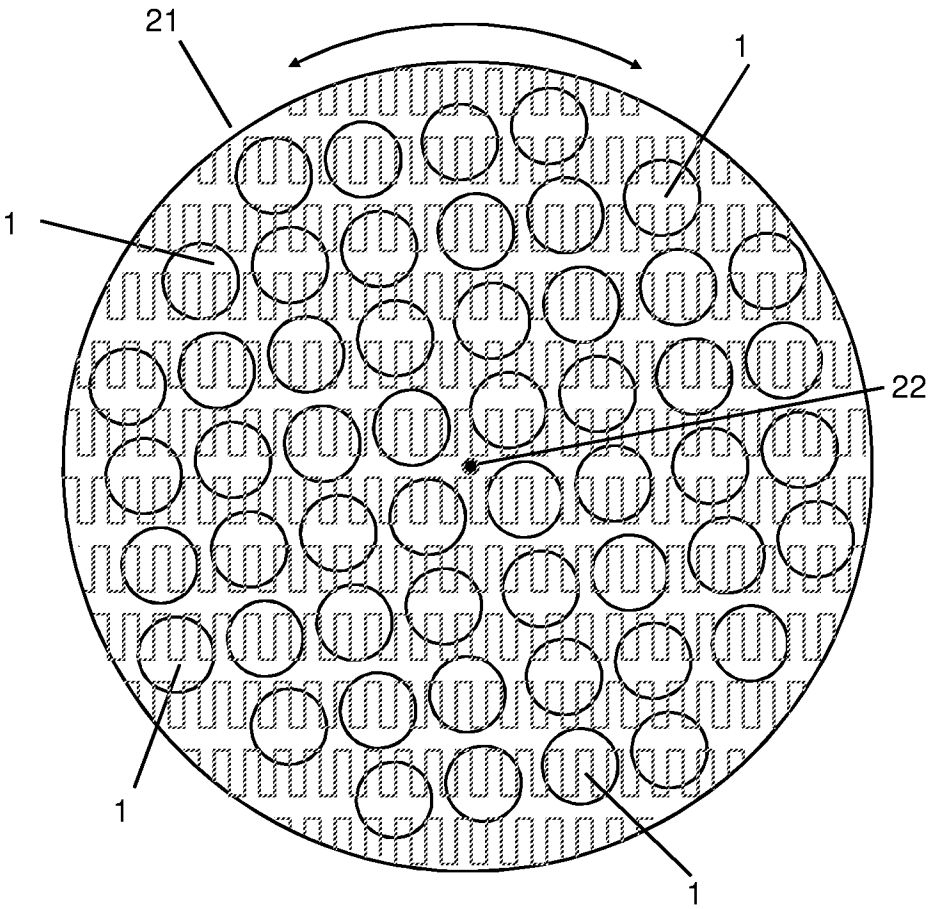
FIG. 9 shows an antenna array with a shared additional polarizer, consistent with embodiments of the present disclosure.

One exemplary embodiment of an antenna array, which consists of phase-controlled antenna elements 1 consistent with the disclosure, and which is equipped with a polarizer 21 that is located rotatably above the antenna group, is shown schematically in FIG. 9.

The antenna array in FIG. 9 consists of fifty two antenna elements 1, which are located in a two-dimensional field in a circular pattern. Above the antenna group a shared polarizer 21 is mounted rotatably; it covers a plurality, and in particular all, of the antenna elements 1.

The polarizer 21 is designed here as a meander polarizer and can be rotated about an axis 22, which is perpendicular to the antenna field.

If a wave of linear polarization now drops into the arrangement, then the polarizer 21 can be rotated such that it transforms this wave of linear polarization into a wave of circular polarization.

In a meander polarizer, this may be an angle of rotation, in which the axes of the meandering lines form an angle of 45° with the polarization vector of the incident wave. Conversely, at other angles of rotation, a wave of generally elliptical polarization occurs.

The signal thus transformed into a signal of circular polarization is fed into the phase-controlled antenna elements 1 of the antenna array, which are designed for instance in accordance with the exemplary embodiments described in FIG. 3, 7 or 8. The phase position of the signal can again, in the manner already described, be adjusted via the phase actuators 3 of the individual antenna elements 1, and the primary beam of the antenna group can be controlled accordingly.

Figure 10:
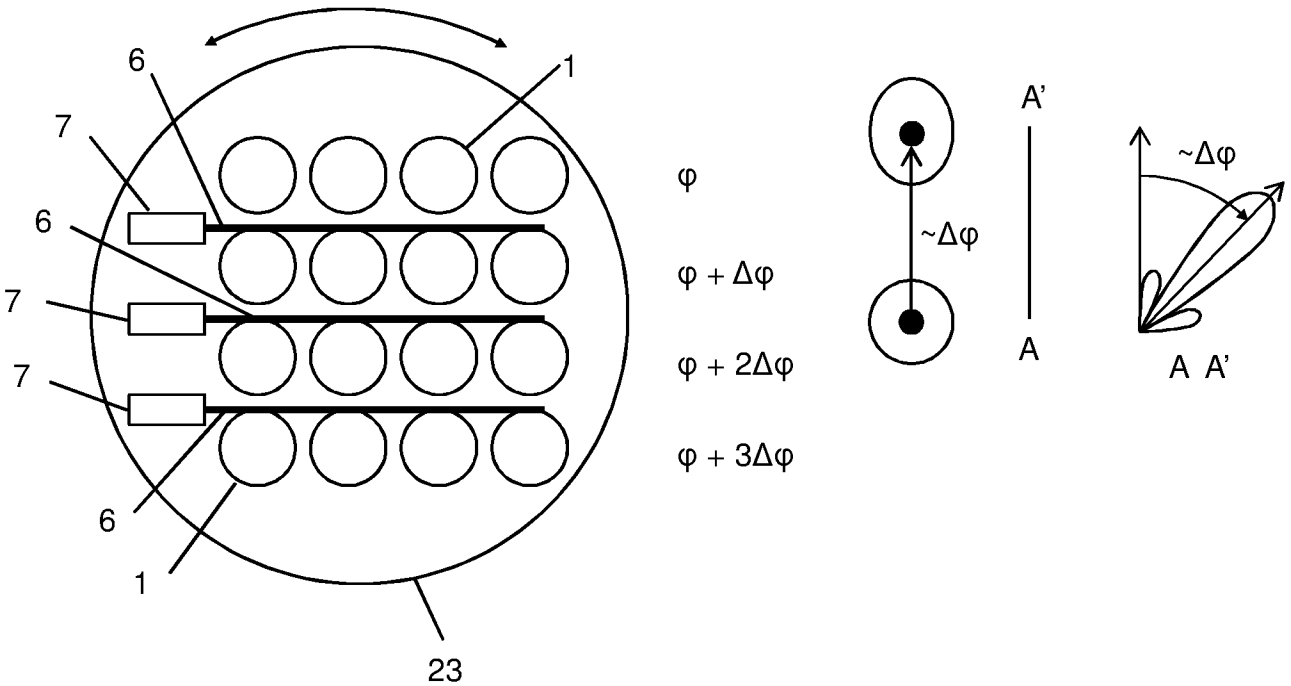
FIG. 10 shows an antenna array with a shared drive unit for a plurality of antenna elements, consistent with embodiments of the present disclosure.

A further embodiment of the disclosure is shown schematically in FIG. 10. The antenna array consists of a two-dimensional field of sixteen phase-controlled antenna elements 1, which are arranged quadratically. In contrast to the previous exemplary embodiments, however, not every antenna element has its own drive 7; instead, four antenna elements located in a row have a common drive. The drives 7 are connected to each of the phase actuators 3 of the four antenna elements 1 with the aid of the connection elements 6. The phase actuators of a row of the antenna group may be rotated together.

The uppermost row has no drive. The phase actuators of these antenna elements are adjusted identically and thus determine the reference phase $\phi$. Since for the orientation of the primary beam of the antenna array, only the relative phase positions of the signals of the antenna elements is critical, such an arrangement is very generally possible.

The directions into which the primary beam of the antenna array with this arrangement can be pivoted, however, are restricted to a single plane, which is located perpendicular to the two-dimensional antenna field and parallel to the line A A' indicated in FIG. 10. The primary beam can be pivoted only in that plane.

If the phase actuators of the various rows of the antenna group are now adjusted with the aid of the drives 7 such that a fixed relative phase difference of $\Delta\phi$ exists between the rows, the antenna beam of the antenna array then pivots away from the normal of the two-dimensional field in that plane. The pivot angle is again proportional to the phase difference $\Delta\phi$.

The restriction of the pivoting range to one plane, however, need not, for many applications, mean any restriction in the scope of function of the antenna arrays thus formed.

If the antenna array is mounted on a rotatable carrier 23 and can be rotated about an axis which is perpendicular to the antenna field, then the primary beam of the arrangement can again be controlled into any direction in the hemisphere located above the arrangement.

An advantage of the embodiment may be that the number of required drive units is reduced sharply. In general, N drives, where N designates the number of antenna elements of an antenna array, is no longer needed; now only $\sqrt{N}$ drives are needed. All that is then added is a drive for rotating the antenna array as a whole.

For applications in which the only criterion is as low a profile of the antenna array as possible, and in which no overly high beam pivoting speeds are necessary, this form of embodiment can be advantageous.

Since the pivoting range, located in a plane perpendicular to the antenna field, includes an angle range of −90° to +90°, the angle range required for the rotation of the antenna group is again merely 180°. Thus no complete rotation is necessary. Complicated high-frequency rotary vias are unnecessary.

In a simple embodiment, not shown, the antenna group is mounted for instance on a flat-bed support and is rotated by a drive located outside, and the signal lines as well as the supply and control lines of the drives are carried to the antenna group with the aid of flexible cables or cable winders (e.g., "cable wraps").

The drive units 7 of the individual rows can for instance with the aid of gear wheels or drive belts rotate the axes of the phase actuators 3 of the antenna elements 1 of one row. Worm drives or screw drives, for instance, are also possible as connection elements 6.

Having described aspects of the present disclosure in detail, it will be apparent that further modifications and variations are possible without departing from the scope of the present disclosure. All matter contained in the above description and shown in the accompanying drawings shall be interpreted as illustrative and not in a limiting sense.

The invention claimed is:

1. A phase-controlled antenna array, comprising:

at least four phase-controlled antenna elements, connected via at least one feed network, wherein a phase-controlled antenna element of the at least four phase-controlled antenna elements includes:

a waveguide emitter having a signal coupling, a phase actuator mounted rotatably in the waveguide emitter and including a holder and at least two polarizers, each of the at least two polarizers configured to convert between a circularly polarized signal and a linearly polarized signal, a connection element, and a drive unit, mounted on a carrier, wherein the drive unit is connected to the phase actuator via the connection element, the drive unit configured to rotate the phase actuator about an axis of the waveguide emitter, an electronic control unit connected via control lines to the drive unit, the electronic control unit configured to adjust the rotation of the phase actuator, wherein between an aperture in the waveguide emitter and the phase actuator, or between the phase actuator and the signal coupling, at least one additional polarizer is mounted in the waveguide emitter, the at least one additional polarizer configured to convert between a signal with linear polarization and a signal with circular polarization, and wherein the at least one additional polarizer, being mounted between the aperture in the waveguide emitter and the phase actuator, is mounted rotatably in the waveguide emitter, and has an additional drive and an additional connecting element, so that the additional drive with the aid of the additional connecting element is configured to rotate the at least one additional polarizer independently of the phase actuator about the axis of the waveguide emitter.

2. The antenna array of claim 1, wherein the waveguide emitter comprises a cylindrical waveguide portion or a horn emitter.

3. The antenna array of claim 1, wherein the waveguide emitter is configured as a round waveguide.

4. The antenna array of claim 1, wherein the at least two polarizers are mounted perpendicularly to the axis of the waveguide emitter and parallel to one another on the holder.

5. The antenna array of claim 1, wherein the at least two polarizers comprise meander polarizers.

6. The antenna array of claim 1, wherein the connection element comprises a shaft which connects the phase actuator to the drive unit.

7. The antenna array of claim 1, wherein the drive unit comprises an actuator including electroactive materials.

8. The antenna array of claim 1, wherein the connection element or the drive unit is equipped with an angular position transmitter.

9. The antenna array of claim 1, wherein the signal coupling comprises microstrip lines.

10. The antenna array of claim 1, wherein the signal coupling comprises two parts and is configured to respectively communicate two orthogonal modes of the waveguide emitter.

11. The antenna array of claim 1, wherein the waveguide emitter comprises dielectric packing material that at least partially fills the waveguide emitter.

12. The antenna array of claim 1, wherein the at least four phase-controlled antenna elements of the antenna array are arranged in rows, and each row of the rows includes a common drive unit and a plurality of connection elements connected to a plurality of phase actuators, the common drive unit configured to rotate the plurality of phase actuators of a row together.

13. The antenna array of claim 1, wherein each of the at least four phase-controlled antenna elements comprise a respective waveguide emitter, phase actuator, connection element, and drive unit, and wherein the electronic control unit is configured to adjust the rotation of respective phase actuators.

* * * * *